United States Patent [19]

Hergeth

[11] 4,187,052

[45] Feb. 5, 1980

[54] METHOD OF OPENING BALES

[75] Inventor: Herbert Hergeth, Dulmen, Fed. Rep. of Germany

[73] Assignee: Hergeth KG. Maschinenfabrik und Apparatebau, Dulmen, Fed. Rep. of Germany

[21] Appl. No.: 24,250

[22] Filed: Mar. 27, 1979

Related U.S. Application Data

[63] Continuation-in-part of Ser. No. 890,215, Mar. 27, 1978, which is a continuation of Ser. No. 609,923, Aug. 12, 1975, abandoned.

[51] Int. Cl.[2] ..... B65G 65/02

[52] U.S. Cl. ..... 414/786; 414/627; 179/113

[58] Field of Search ..... 414/786, 618, 627, 267, 414/917; 294/64 B, 64 R; 198/11-13, 58

[56] References Cited

U.S. PATENT DOCUMENTS

| | | | |
|---|---|---|---|
| 2,776,163 | 1/1957 | Cremer | 294/64 R |
| 3,542,241 | 11/1970 | Middelditch | 179/113 |
| 3,571,839 | 3/1971 | Hartmann | 294/64 R |
| 3,716,134 | 2/1973 | Campbell | 414/627 |
| 3,759,560 | 9/1973 | Yodo et al. | 294/64R |
| 3,777,908 | 12/1973 | Keller | 414/267 |
| 3,782,560 | 1/1974 | Kahwati et al. | 294/64 R |
| 3,834,555 | 9/1974 | Bennington | 414/627 |
| 3,865,254 | 2/1975 | Johannsmeier | 414/627 |
| 3,917,051 | 11/1975 | Pennings et al. | 414/139 |

*Primary Examiner*—Albert J. Makay
*Assistant Examiner*—Lawrence E. Williams
*Attorney, Agent, or Firm*—Diller, Ramik & Wight

[57] ABSTRACT

This disclosure relates to a method of removing a generally uniform layer portion of fibrous material from the top of a bale of compressed fibrous material and loosening the fibers of the layer portion during the removal thereof by providing a bale of relatively compressed fibrous material having a predetermined upper surface area, providing a suction hood having an overall area corresponding in size generally to the upper surface area of the fibrous bale, creating at least two spaced linear areas of suction across the overall area of the hood while preventing the creation of suction between the two linear suction areas, positioning the suction hood in overlying contiguous relationship to the bale upper surface area whereby the suction draws the fibrous material upwardly across the overall area and loosens the compressed condition thereof to a generally fluffed state through a uniform depth thereof, raising the suction hood to remove a general uniform depth of the loosened fibrous material across generally the entirety of the predetermined surface area, and subsequently discontinuing the suction to release the loosened fibrous material layer portion from the suction hood for subsequent processing.

3 Claims, 5 Drawing Figures

METHOD OF OPENING BALES

This application is a continuation-in-part application of application Ser. No. 890,215 in the name of Herbert Hergeth filed Mar. 27, 1978 which in turn is a continuation application of application Ser. No. 609,923 filed Aug. 12, 1975 now abandoned.

This invention relates to novel apparatus for removing fibrous material from a bale and transferring the same to a different site for either further conveyance or subsequent operations, the apparatus being particularly adapted for opening bales of fibrous material, such as spinning material, in which the fibrous material is removed in succession from each bale of a row of bales.

Apparatus of various types are used for removing fibrous material from bales of spinning material, such as cotton, and in one such conventional apparatus the fibrous baled material is removed by revolving tools, such as rotary spiked rollers, which are moved to and fro along a peripheral surface of the bale.

In another conventional apparatus belts with pins or a scraper or card coverings are guided around deflecting rollers and engage the bale or the row of bales.

In another conventional apparatus gripper devices are used for removing the fibrous baled material from one bale or from a row of bales with the gripper devices having pincer-like fingers by means of which the fibers are plucked from the baled material. The thus plucked-out fibrous material is fed by the grippers to a conveyor or like transfer device.

A common feature of conventional apparatus of this type is that the opening procedure is carried out by use of mechanical means and a variety of mechanical tools to tear out the fibrous material from the blade. One difficulty is maintaining the servering or plucking tools clean during the removal procedure in order to insure maximum uniformity of removal during the entire removing or opening operation.

A primary object of this present invention is to provide novel apparatus which overcomes the non-uniformity of removal of fibrous material by conventional means through the use of means for providing a suction effect which draws the bale of fibrous material from a package or fibrous material from a bale with the suction effect being interrupted at a point of desired discharge. By removing the fibrous material by the use of suction, mechanical gripping or plucking tools are necessary, and the necessity of providing a close relationship between the latter and the fibrous material is also eliminated. By the use of a suction head through which air is drawn, the fibrous material is sucked against a suction head to which it is held during removal, and after transfer to a desired position, the suction is interrupted and the fibrous material can then drop off with no risk of the material remaining adhered to the suction head. Furthermore, by this utilization of a suction head in the absence of mechanical tools, the fibrous material is treated gently and there is an overall simplification of the apparatus, as compared to conventional machines.

The suction head of the present apparatus is preferably closed by a screen plate and is connected by a suction pipe to an exhaust fan or the like. Preferably the suction pipe and suction head are commonly pivotally mounted to a main frame with the suction pipe being constructed from flexible material to permit the suction head to be readily raised and lowered during the operation of the apparatus. Preferably the movement (raising and lowering) of the suction head is controlled in dependence upon a predetermined low pressure value of suction created between the suction head and the bale such that upon lowering the suction head upon the bale of fibrous material and an achievement of desired low pressure valve, the suction head is then automatically raised to remove the bale of fibrous material or portions thereof whereafter it is subsequently transferred to another position.

Since the suction head has a lower flat apertured surface through which the suction can take effect upon the bale of fibrous material, the latter will not remain adhered to the suction head once the suction is interrupted.Thus, the suction head is automatically freed of fibrous material and this insures that the fibrous material is removed from the package in a maximum uniformed manner.

The suction head is preferably joined to the main frame through a linkage assembly which is pneumatically or hydraulically operated and the main frame is also preferably mounted upon a turntable. The turntable is operated in dependence upon the position of the linkage and after a removal operation, the position of the linkage automatically institutes the rotation of the turntable which may be controlled by a time switch to reach the discharge point. Thus, the entire mechanism for removing baled fibrous material and for conveying the removed material to a discharge point and the return thereof to its original position may be controlled in dependence upon the suction effect or upon a predetermined degree of vacuum pressure.

The suction achieved at the suction head or a mouthpiece of the latter may be obtained in various ways, for example, by a suction fan directly housed within the suction head. In this embodiment, the suction pipe is connected between the fan and a filter device mounted on the turntable. If a blower fan is used to provide the suction, it is advantageous to locate the fan, for example, a high pressure circular fan, on the main frame or the turntable associated therewith. In the latter case, a filter device may be mounted on the frame and/or turntable between the suction pipe and the fan with the filter device preferably being of a disposed type.

In order to remove baled fibrous material from a row of bales or bales encased in packages, the turntable is preferably mounted on a mobile chassis which is movable along a conveyor upon which the removed fibrous material is deposited and thereby conveyed to a subsequent operating mechanism (mixed-bale breaker).

In keeping with the present method, the apparatus just described not only removes a generally uniform layer portion of fibrous material from the top of a bale of compressed fibrous material, but also loosens the fibers of the layer portion during the removal thereof. The latter is performed by first providing a bale of relatively compressed fibrous material having a predetermined upper surface area. The earlier described suction head or suction hood is of an overall area corresponding in size generally to the upper surface area of the fibrous bale and is so constructed as to create at least two spaced linear areas of suction across the overall area of the hood while preventing the creation of suction between the two linear suction areas. The suction hood is positioned in overlying contiguous relationship to the bale upper surface area, whereby the suction draws the fibrous material upwardly across the overall area and loosens the compressed condition thereof to a generally fluffed state through a uniform depth. Once the latter is created, the suction hood is raised to remove the generally uniform depth of the now loosened fibrous material across generally the entirety of the predetermined surface area and once so removed, the suction is discontinued to release the loosened fibrous material layer portion from the suction hood for subsequent processing.

With the above and other objects in view that will hereinafter appear, the nature of the invention will be more clearly understood by reference to the following detailed description, the appended claimed subject matter, and the several views illustrated in the accompany drawings.

IN THE DRAWINGS

Figure 1:
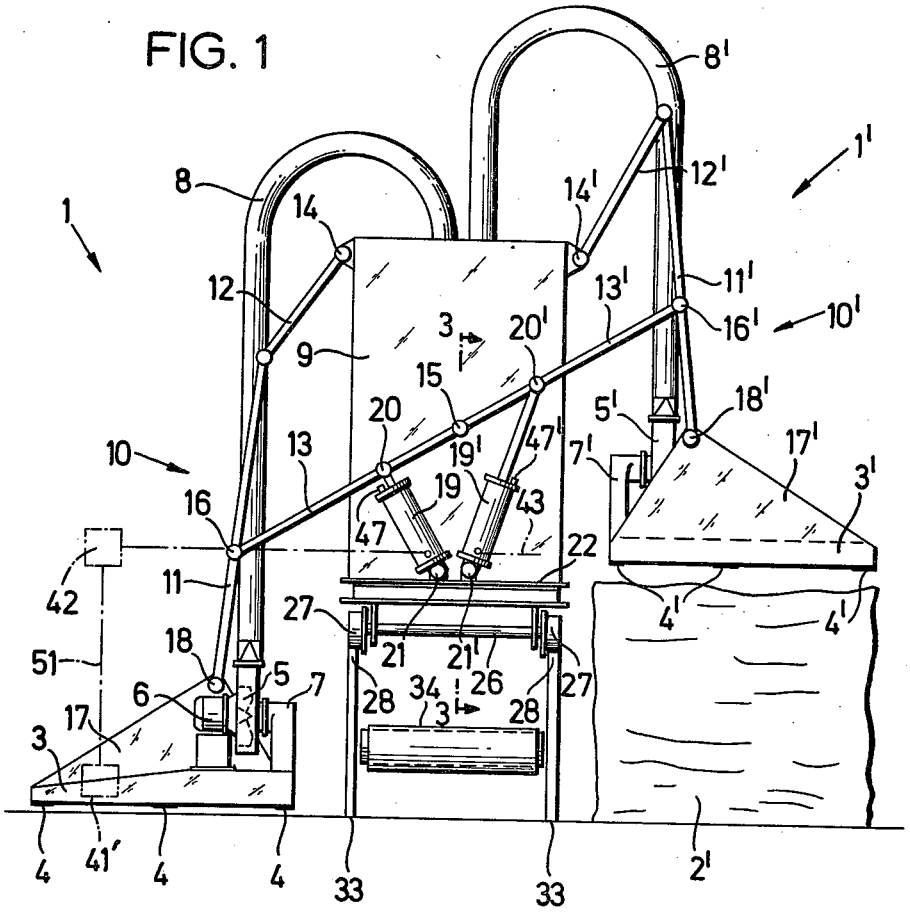
FIG. 1 is an end view of a novel apparatus constructed in accordance with this invention, and illustrates a pair of suction heads in respective lowered and raised positions, linkage means for supporting the same and pneumatic means for moving the suction heads between the raised and lowered positions through the linkage mechanism.

A novel apparatus constructed in accordance with this invention for removing fibrous material from bales 2' (only one of which is shown) includes a pair of identical devices 1, 1' carried by a main frame 9. The devices 1, 1' each include a suction head or hood 3,3', respectively, having an overall area corresponding in the size generally to an upper surface area of the associated fibrous bale. Each suction hood 3,3' includes two or more apertured plates or screens 4,4', respectively, with the areas between the screens 4,4' being closed to the suction effect. Thus, the screens 4,4' define linear areas of suction across the overall area of the hood, while the closed areas between the screens 4,4' prevent the creation of suction between the linear suction areas created by the screens 4,4'. The suction heads 3,3' are moved by means to be described more fully hereinafter between a lowermost position, shown by the suction head 3, and an uppermost position illustrated by the suction head 3', as is best illustrated in FIG. 1. The screens or apertured plates 4,4' prevent good fibers from being drawn from the bale 2 into the suction heads 3,3', and depending upon the particular type of fibrous material involved, the screen plates 4,4' may be of varying mesh sizes and if in the form of apertured plates, the number and size of apertures may also vary in dependence upon the type of fibrous material involved. The spacing (closed) between the apertured plates or screens 4,4' may also be varied, or might also be the number of apertured plates or screens spanning each hood 4,4' to thus control the suction effect upon the fibrous material.

In order to generate negative pressure or suction, fans 5,5' are driven by motors 6,6' and are connected to the suction heads 3,3' by pipes 7,7'. Flexible pipes 8,8' are connected to the blowers 5,5' and lead into the main frame 9 which may be constructed as a dust collector box.

Figure 3:
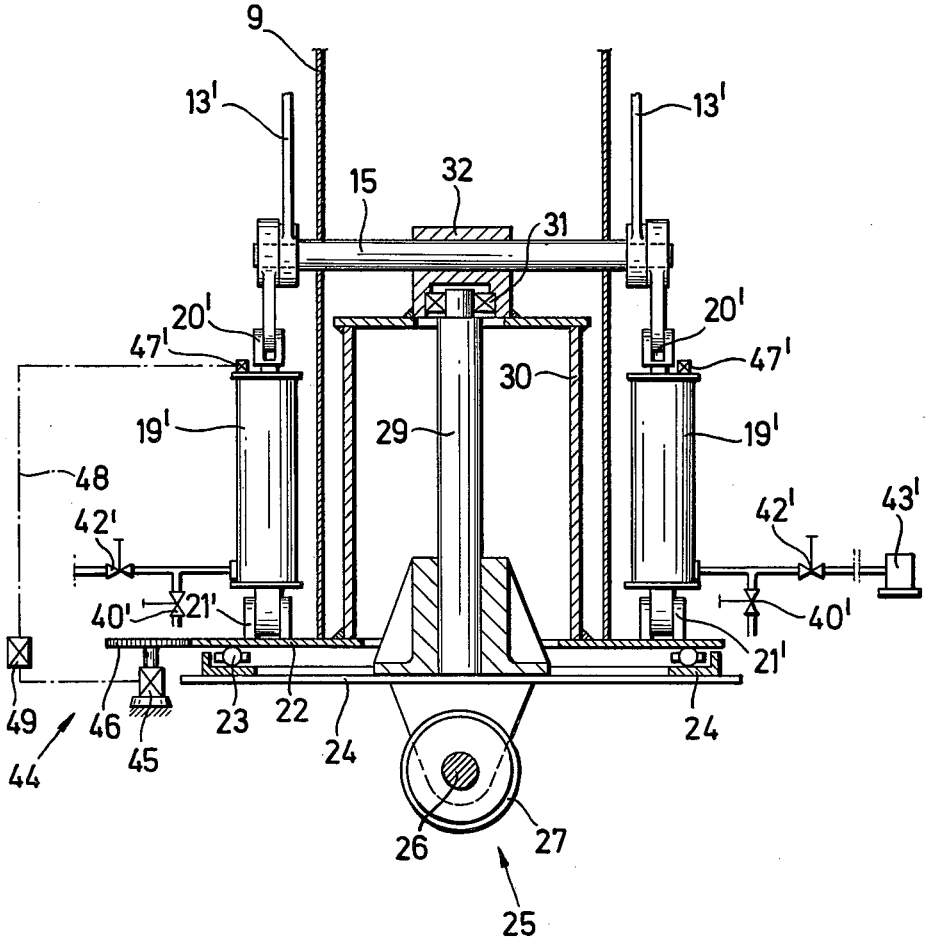
FIG. 3 is an enlarged fragmentary sectional view taken generally along 3—3 of FIG. 1, and illustrates details of the apparatus, including means for rotating the turntable.

Means for moving the suction heads 3,3' vertically between the lowermost position illustrated in FIG. 1 by the suction head 3 and the uppermost position shown by the suction head 3' includes linkage means 10, 10' consisting respectively of links 11, 11', 12, 12' and 13, 13'. The links 12, 12' are pivotally connected at 14, 14' to the main frame 9, and the links 13, 13' are likewise pivotally connected at one end to a pivot 15 of the main frame 9 and at their opposite ends are pivotally connected to the links 11, 11' by pivots 16, 16'. The links 11, 11' are also pivotally connected to frames 17, 17' of the suction heads 3,3' by pivots 18, 18'. The various links of the linkage means 10, 10' are also constructed and arranged relative to one another in regard to their lengths and points of connection that an absolutely rectilinear vertical raising of the suction heads 3,3' is achieved. The means for lifting the linkage means 10, 10' includes pneumatic or hydraulic rams 19, 19' pivotally connected to the links 13, 13' at pivots 20, 20' and are also pivotally connected by pivots 21, 21' to a turntable 22. The turntable 22 rests upon roller bearings 23 (FIG. 3) which in turn are supported on a support plate or a race 24 forming an integral portion of a mobile chassis 25 having an axle 26 suitably journaled thereto carrying wheel 27 which travels on rails 28. The support plate 24 is provided with a post 29 which supports the turntable 22 by means of a cylindrical housing 30 and a ball bearing 31. As is best shown in FIG. 3, the pivot 15 for the links 13, 13' is a shaft supported by a block 32 carried by an upper plate (unnumbered) of the cylindrical housing 30. Thus, the suction heads 3,3', the suction pipes 8,8', the main frame 9, and the linkages 10, 10' are supported as a unit upon the turntable 22.

Figure 5:
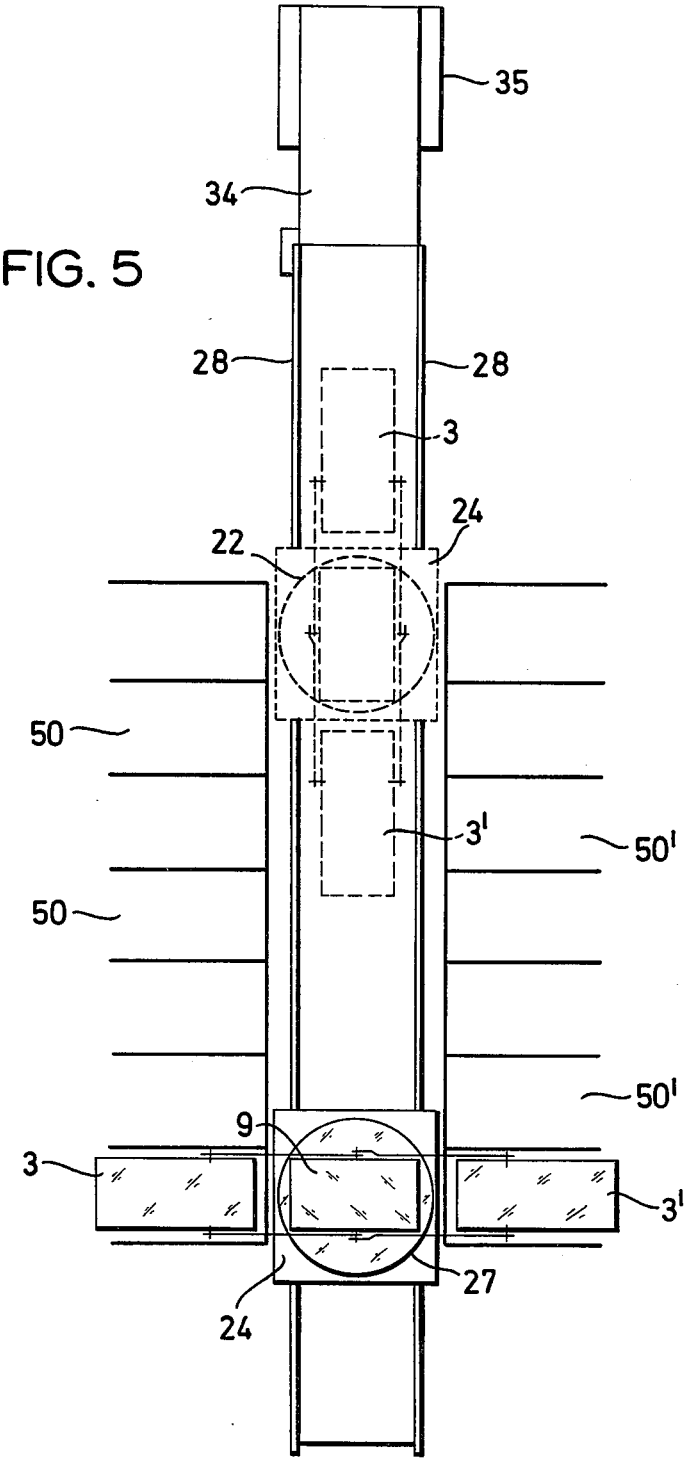
FIG. 5 is a top plan view of a system utilizing the apparatuses of FIGS. 1 through 4, and illustrates the manner in which baled fibrous material may be removed from a row of packages or bales by mounting the apparatus upon a mobile chassis.

The rails 28 are mounted on supports 33 (FIG. 1) between which may be a conventional conveying device 34, such as a belt conveyor, which serves as a deposit surface for material removed from the bales 2. The purpose of the conveyor 34 is to transport removed fibrous material for further processing to a conventional mixed-bale breaker 35 (FIG. 5) or like fabricating machinery.

In the "home" position of the devices 1, 1', both suction heads 3, 3' are in their uppermost or raised positions, as indicated by the suction head 3' in FIG. 1 with the rods (unnumbered) of the lifting rams 19, 19' being fully extended. Thereafter the lifting rams 19, 19' are exhausted by means of magnetic valves 40' (FIG. 3) and due to their own weight, the suction heads 3,3' with their linkages 10, 10' lower onto upper surfaces of the bales 2 of fibrous material. With the fans 5,5' being in operation, a suction effect is created with through the suction plates 4,4' secures the bales or portions thereof or the fibrous material thereof to the suction heads 3,3' and as this occurs, the vacuum on the suction side of the fans 5,5' increases correspondingly. When a predetermined vacuum level has been reached, the cylinders 19, 19' are automatically charged with air from a compressed air source 43' by means of pressure membrane switches 41' and magnetic valves 42'. The rods (unnumbered) of the cylinders 19, 19' therefore begin to extend and are raised to their maximum upper position. The reference numeral 43 represents the control line between the pressure membrane switch 41', the magnetic valve 42', and the compressed-air source 43' to effect the introduction of air into the cylinders 19, 19'. When the suction heads 3,3' have reached their upper position, a rotary drive 44 (FIG. 3) for the turntable 22 is operated. The rotary drive 44 includes a motor 45 driving a pinion 46 which is in mesh with teeth (unnumbered) of the turntable 22. The point at which the motor 45 is energized is achieved by switches 47, 47' carried by the rams 19, 19'. As the rods 19, 19' of the rams extend, they move in an arcuate path and located along this path is an abutment (not shown) carried by the main frame 9 which contacts the switches 47, 47' to close the same and energize the motor 45. A suitable control line 48 is coupled between the switches 47', an conventional time switch 49 and the motors 45. Upon the energization of the motor 45, the turntable is rotated through 90 degrees and the suction heads 3,3' now lie over the belt conveyor 34, as shown in dotted outline in FIG. 5. When this position is reached, the suction is switched off by simply switching off the fans 5,5' or by opening a secondary air flap or any other suitable venting device. In this way, the vacuum in the suction heads 3,3' is interrupted and the fibrous material previously held fast by the suction thereto no longer adheres and the fibrous material then drops to the conveyor 34. After the material has dropped off, the motor 45 is reversed by the timing out of the time-switch 49 and returns the suction heads 3,3' to their starting position (FIG. 1).

If a row of bales is present in stalls 50, 50' (FIG. 5), the units 3,3', 8,8', 10, 10' and 9 mounted atop the rotary plate 22 advance by one division to the next bale or pairs of bales located in stalls 50, 50' whereupon the procedure just described begins anew and is repeated.

It is to be understood that though the operation just described was made with reference to elements 42', 43', 47', etc., which are illustrated predominatly associated with the device 1', like components (not shown) are associated with the device 1 to operate both devices 1, 1' in the manner heretofore described.

Figure 2:
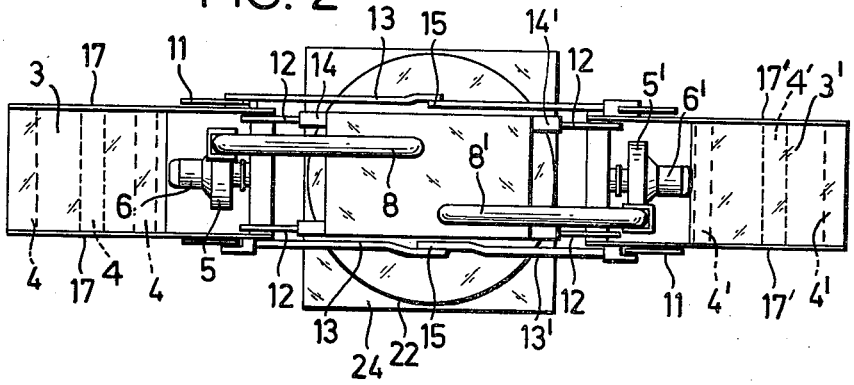
FIG. 2 is a top plan view of the apparatus of FIG. 1, and illustrates the manner in which a turntable supports the suction heads through the linkage mechanism for rotation about a generally vertical axis.
Figure 4:
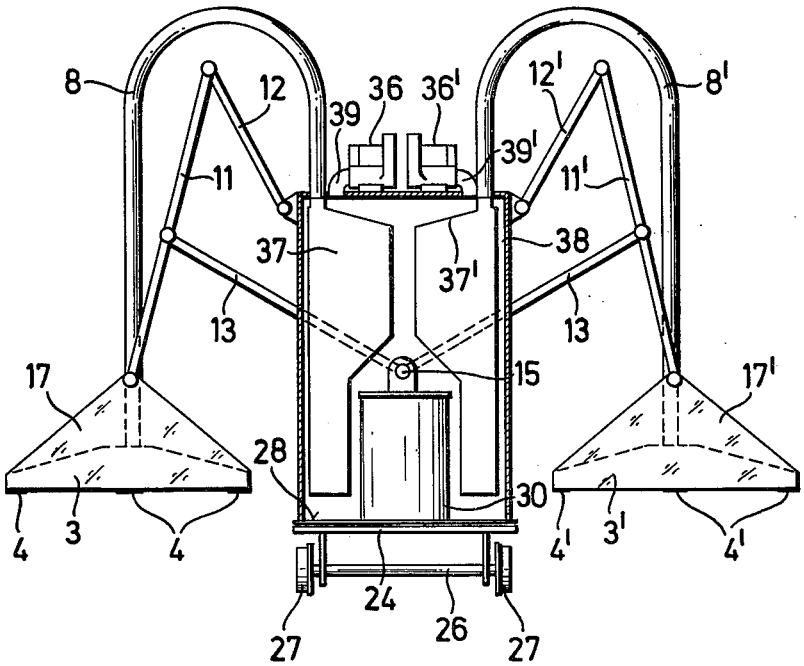
FIG. 4 is an end view of another apparatus, partially in cross-section, constructed in accordance with this invention, and illustrates disposable filters carried by a main frame which in turn is supported by a turntable.

Reference is now made to the embodiment of the invention illustrated in FIG. 4 in which like components corresponding to those of the embodiment of the invention shown in FIGS. 1 through 3 bear similar reference numerals. However, in the mechanism of FIG. 4, there is illustrated a different suction arrangement including the fans 36, 36' in the form of high-pressure annular fans directly connected by flexible pipes 8, 8' to the suction heads 3,3'. The flexible pipes 8, 8' open into filter bags 37, 37' which are housed in the main frame or casing 38 on which the fans 36, 36' are mounted. The filters or filter bags 37, 37' are designed to be readily changed and are desirably of the disposable type. The casing 38 is connected to the fans 36, 36' by pipes 39, 39', and each fan includes an associated motor. In this case, the amount of air which is exhausted is very small and, thus, the exhaust air may be blown into the room without causing additional dust development.

From a method standpoint, the apparatus is operative in the manner heretofore described to remove a generally uniform layer portion of fibrous material from the top of the bale 2' of compressed fibrous material while at the same time loosening the fibers of the layer portion during the removal thereof. This is accomplished by first recognizing that the bale 2' is formed of relatively compressed fibrous material, and the upper surface area thereof corresponds in size and shape to the overall area of the suction hoods 3,3' (FIG. 2). When a suction is drawn through the conduits 8,8', air is drawn through the screens or aperture plates 4,4' of the hoods 3,3' and in this manner, at least two spaced linear areas of suction are created across the overall area of the hoods 3,3' in the regions of the aperture plates or screens 4,4', while the areas therebetween are closed to the effect of the suction. Thereafter, the suction hoods 3,3' are placed in overlying contiguous relationship to the bale upper surface whereupon the suction draws the fibrous material upwardly across the overall area and loosens the compressed condition thereof to a generally fluffed state through a uniform depth thereof. In this manner, the fibrous material is loosened through a uniformed depth of the bale across its overall area, and the latter portion of the bale is removed upon the raising of the suction hoods 3,3' with which is then carried the generally uniform depth of the loosened fibrous material which is subsequently released when the suction is discontinued and thereafter the released loosened fibrous material layer portion can be subsequently processed.

While preferred forms and arrangement of parts have been shown in illustrating the invention, it is to be clearly understood that various changes in details and arrangement of parts may be made without departing from the scope and spirit of this disclosure.

What is claimed is:

1. A method of removing a generally uniform layer portion of fibrous material from the top of a bale of compressed fibrous material and loosening the fibers of the layer portion during the removal thereof comprising the steps of providing a bale of relatively compressed fibrous material having a predetermined upper surface area, providing a suction hood having an overall area corresponding in size generally to the upper surface area of the fibrous bale, creating at least two spaced linear areas of suction across the overall area of the hood while preventing the creation of suction between the two linear suction areas, positioning the suction hood in overlying contiguous relationship to the bale upper surface area whereby the suction draws the fibrous material upwardly across the overall area and loosens the compressed condition thereof to a generally fluffed state through a uniform depth thereof, raising the suction hood to remove a generally uniform depth of the loosened fibrous material across generally the entirety of the predetermined surface area, and subsequently discontinuing the suction to release the loosened fibrous material layer portion from the suction hood for subsequent processing.

2. The method as defined in claim 1 wherein the raising of the suction hood is performed by moving the suction hood along a generally vertical path of travel from a first position to a second upper position and thereafter moving the suction hood along a second path of travel toward a third position before discontinuing the suction to release the loosened fibrous material layer portion at the third position.

3. The method as defined in claim 1 wherein the at least two spaced linear areas of suction are formed by perforate members while imperforate members are disposed therebetween to prevent the creation of suction.

* * * * *

UNITED STATES PATENT AND TRADEMARK OFFICE

CERTIFICATE OF CORRECTION

PATENT NO. : 4,187,052

DATED : February 5, 1980

INVENTOR(S) : Herbert Hergeth

It is certified that error appears in the above-identified patent and that said Letters Patent are hereby corrected as shown below:

-- [30] Foreign Application Priority Data

August 17, 1974 Germany 2439520 --.

Signed and Sealed this

*Fifteenth* Day of *April 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4,187,052

DATED : February 5, 1980

INVENTOR(S) : Herbert Hergeth

It is certified that error appears in the above-identified patent and that said Letters Patent are hereby corrected as shown below:

---[63] Continuation-in-part of Serial No. 890,215, Mar. 27, 1978, which is a continuation of Serial No. 603,923, August 12, 1975, abandoned.---

Signed and Sealed this

*Twenty-second* Day of *July 1980*

[SEAL]

*Attest:*

SIDNEY A. DIAMOND

*Attesting Officer*

*Commissioner of Patents and Trademarks*